US005915345A

United States Patent [19]

Kling et al.

[11] Patent Number: 5,915,345

[45] Date of Patent: Jun. 29, 1999

[54] INJECTION NOZZLE FOR PISTON COOLING IN AN INTERNAL COMBUSTION ENGINE

[75] Inventors: Jürgen Kling, Wiernsheim; Jürgen Poth, Friolzheim; Olaf Fiedler, Remchingen; Achim Bauer, Kusterdingen, all of Germany

[73] Assignee: Dr. Ing. h.c.F. Porsche AG, Weissach, Germany

[21] Appl. No.: 08/898,120

[22] Filed: Jul. 22, 1997

[30] Foreign Application Priority Data

Aug. 17, 1996 [DE] Germany ..... 196 33 167

[51] Int. Cl.[6] ..... F01P 1/04

[52] U.S. Cl. ..... 123/41.35

[58] Field of Search ..... 123/41.35; 239/590.5

[56] References Cited

U.S. PATENT DOCUMENTS

| | | | |
|---|---|---|---|
| 3,423,029 | 1/1969 | Demaison | 239/565 |
| 5,267,534 | 12/1993 | Berlinger | 123/41.35 |

FOREIGN PATENT DOCUMENTS

| | | |
|---|---|---|
| 0057790A1 | 8/1982 | European Pat. Off. . |
| 0423830A1 | 4/1991 | European Pat. Off. . |
| 1934375 | 4/1964 | Germany . |
| 2505019A1 | 8/1975 | Germany . |
| 2853280B2 | 6/1980 | Germany . |
| 3125835C2 | 1/1983 | Germany . |
| 3416076A1 | 1/1985 | Germany . |
| 4012475C2 | 9/1992 | Germany . |
| 504883 | 5/1976 | U.S.S.R. . |
| 330095 | 6/1930 | United Kingdom . |

OTHER PUBLICATIONS

*Turbo Diesel 300 SD* (116.120) USA, 978, Mercedes–Benz Service, Daimler–Benz Aktiengesellschaft,; eingeg. Apr. 10, 1981; pp. 3, 33, 34.

*Primary Examiner*—Noah P. Kamen

*Attorney, Agent, or Firm*—Evenson, McKeown, Edwards & Lenahan, P.L.L.C.

[57] ABSTRACT

The injection nozzle according to the invention for cooling the pistons of an internal combustion engine serves to produce a sharply bundled solid stream. In order to prevent separation of the oil stream at high oil temperatures and the associated low viscosity of the lubricating oil, it is proposed to provide at least two exit channels approximately parallel to one another, whose spacing is less than twice the diameter of the larger exit channel. With this design of two exit channels that are located very close together, an oil stream is produced that is a coherent solid stream a short time after leaving the exit channels.

17 Claims, 1 Drawing Sheet

INJECTION NOZZLE FOR PISTON COOLING IN AN INTERNAL COMBUSTION ENGINE

BACKGROUND AND SUMMARY OF THE INVENTION

This application claims the priority of 196 33 167.6, filed in Germany on Aug. 17, 1997, the disclosure of which is expressly incorporated by reference herein.

The invention relates to an injection nozzle for piston cooling in an internal combustion engine with at least one exit channel to produce a solid/coherent cooling stream.

In internal combustion engines the pistons are under high stress and must frequently be cooled to avoid excessively high piston temperatures. Excessively high piston temperature, especially in alloys, has a negative effect on the long term strength of the piston. In addition, as a result of very high piston temperatures, thermally produced buildup of carbon and deposits in the piston ring grooves may occur. In addition, as the piston temperature increases, because of thermal expansion, deviations from the original piston geometry increase as well. The areas of maximum temperature on the piston bottom depend on the position of the spark plugs, the valve geometry, and the ignition point. The area of maximum temperature is usually located in the vicinity of the exhaust valves.

An effective and relatively economical solution for reducing the piston bottom temperatures is spraying the piston bottom with lubricating oil from the oil circuit of the internal combustion engine. For this purpose, injection nozzles are located in the vicinity of the crankcase and/or the crankshaft drive. The nozzles are connected with the lubricating oil circuit of the engine and an oil stream is directed at the underside of the piston bottom. An injection nozzle of this kind is described, for example, in German Patent Document DE 40 12 475 C2. In such nozzles for producing a solid stream, it has been shown that as the oil temperature increases and the viscosity of the oil begins to fall as oil pressures increase at the same time, the oil stream separates so that a coherent stream of oil no longer reaches the bottom of the piston.

In addition, a spray nozzle for cooling the pistons of an internal combustion engine is known from German Patent Document DE 31 25 835 C2 in which the end channel is formed by folding a tube, thereby forming an end channel having a non-circular shape.

An injection nozzle is known from German Patent Document DE 25 05 019 A1, wherein two or more oil streams are produced that strike different areas of the piston bottom.

An object of the invention is to improve an injection nozzle for cooling the pistons of an internal combustion engine so that a directed coherent oil stream impacts on the piston. The coherent oil stream provides effective cooling over the entire operating temperature range of the internal combustion engine and lubricating oil, especially at high lubricating oil temperatures. An injection nozzle of this kind is simple and economical to manufacture and can be exchanged for conventional injection nozzles without structural changes to the engine.

This object is achieved according to the invention by providing a nozzle which has at least two, at least approximately parallel exit channels spaced apart by a distance smaller than twice the diameter of the larger of the exit channels.

By providing at least two at least approximately parallel end channels in the injection nozzle, and having the distance between the nozzles being less than twice the diameter of the larger exit channel, a directed, coherent and reliable impact on the piston bottom is achieved even at high oil temperatures. As a result of the design of the exit channels according to the invention, even with the same total throughput volume as in a conventional injection nozzle, at high oil temperatures and high pressures, laminar flows form within the channel that prevent the oil stream from prematurely separating. It has been observed that by forming two closely adjacent exit channels according to the present invention, a spray pattern can be produced in which a coherent solid stream forms only 10 mm to 30 mm downstream from the nozzle opening. The resultant improvement in piston cooling can be accomplished without any structural changes to the internal combustion engine. In contrast to conventional injection nozzles, only an end piece provided with the exit channels needs to be replaced by an end piece with two or more parallel exit channels. The nozzle support or the nozzle support inserted into the corresponding receiving bore of the internal combustion engine can be shaped exactly as in conventional injection nozzles.

An especially effective and sharp coherence of the oil stream results when the diameter of the exit channels is between approximately 0.8 mm and 1.5 mm.

It has also been found that the coherence of the resultant solid oil stream is especially good and the flow compartmentalization is especially slight when the distance between the exit channels is in the range between 1 and 2 mm.

It is also especially advantageous according to certain preferred embodiments if the diameter of the two or more exit channels is the same. As a result, an especially uniformly shaped solid stream results that can be directed very accurately at the bottom of the piston to be cooled.

An especially favorable flow pattern within the exit channel is obtained and a resultant sharp coherence of the emerging oil stream is achieved if the input area in the exit channel is expanded conically.

An especially simple and economical design of such a spray nozzle is achieved if the nozzle has a nozzle end piece with the exit channels formed therein, and the end piece is inserted into a sleevelike support part. A check valve can then be integrated for example in this carrier type sleeve part.

Other objects, advantages and novel features of the present invention will become apparent from the following detailed description of the invention when considered in conjunction with the accompanying drawings.

DETAILED DESCRIPTION OF THE DRAWINGS

Figure 1:
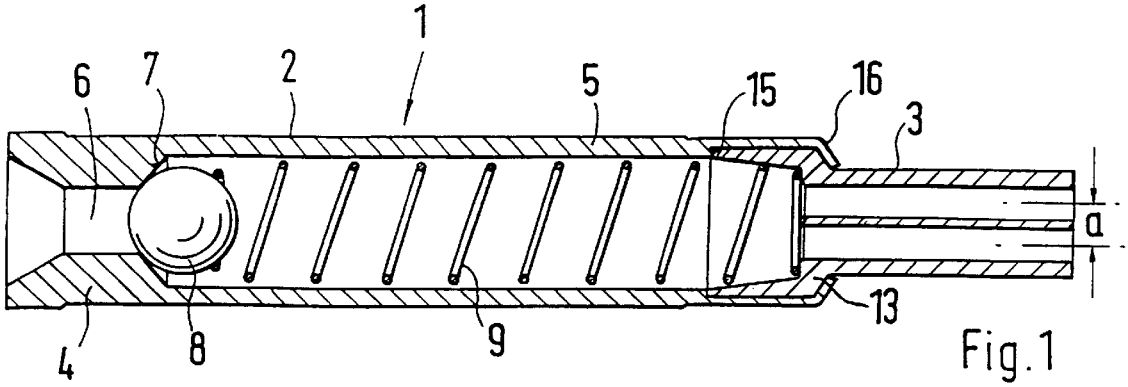
FIG. 1 shows a lengthwise section through an injection nozzle according to the invention.

The injection nozzle 1 shown in FIG. 1 for cooling the pistons of an internal combustion engine comprises a support part 2 and a nozzle end piece 3 connected therewith. Support part 2 has a bottom section 4 and a sleeve-shaped section 5 extending therefrom. A feed bore 6 and a valve seat 7 adjacent thereto are provided in bottom section 4. When injection nozzle 1 is installed, supply bore 6 is connected with the lubricating oil circuit of the internal combustion engine. Valve member 8 is guided inside the sleeve-shaped section 5, and cooperates with valve seat 7. FIG. 1 illustrates valve member 8 as a valve ball in this embodiment. Valve member 8 is biased against the action of the oil flowing through feed bore 6 by a spring 9 against valve seat 7 and acts as a check valve. Spring 9 abuts valve member 8 at one end and a circumferential shoulder 10 of nozzle end piece 3 at the other.

Figure 2:
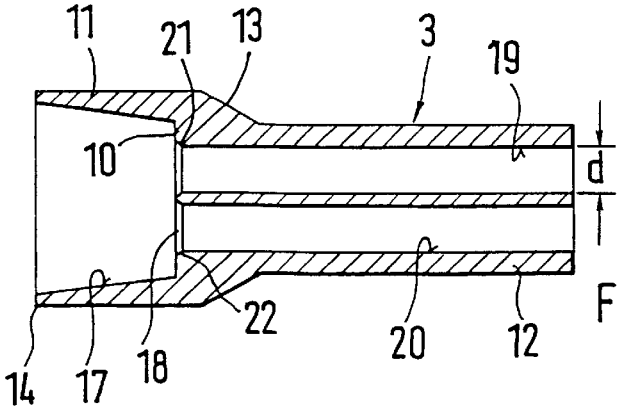
FIG. 2 shows a lengthwise section through a nozzle end piece of this injection nozzle of FIG. 1.
Figure 3:
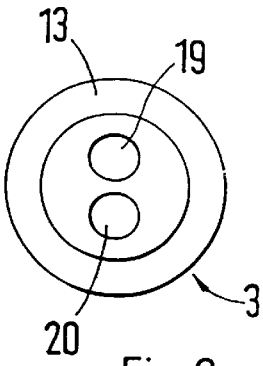
FIG. 3 is a top view of the outlet side of the nozzle end piece of FIG. 2.

Nozzle end piece 3 consists of two cylindrical sections, a first section 11 with a larger diameter and a second section 12 with a smaller diameter. A conical transitional area 13 is formed between the two cylindrical sections 11 and 12. Nozzle end piece 3 is inserted into support part 2 so that the free end 14 of first section 11 abuts a circumferential shoulder 15 of support part 2. By crimping the free edge 16 of the support part, the nozzle end piece is secured. The free edge and/or the crimped section of free edge 16 then abuts conical transition 13. As shown in FIG. 2, at free end 14, a bore 17 extends in first cylindrical section 11. Bore 17 tapers conically to shoulder 10. Two parallel end channels 19, 20 extend from bottom 18 of bore 17. Channels 19, 20 extend longitudinally through second section 12. Input area 21, 22 of the two end channels 19, 20 expands conically toward bore 17. The angle of the conical extension in this embodiment is approximately 45 degrees.

The two end channels 19 and 20 in this embodiment have the same dimensions, in other words the length and the diameter d are the same. The diameter d of each end channel in this embodiment is 1.2 mm. However it is contemplated that the diameter may vary between 0.8 and 1.5 mm as a function of oil pressure, nozzle length, and distance from the piston bottom. The distance a between the center lines of the two exit channels 19, 20 in this embodiment is 1.5 mm. However, distance a can be varied in the range between approximately 1.0 and 2.0 mm. In order to achieve coherence of the two emerging partial streams into a solid stream as soon as possible, the distance a between the center lines of the two exit channels must be kept relatively small, in other words the distance a should be smaller than twice the exit channel diameter d.

Figure 4:
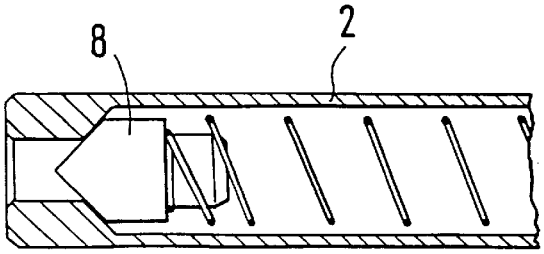
FIG. 4 is a variation on the support part in FIG. 1.

FIG. 4 shows a variation of the support part 2 described in FIG. 1, which differs from the latter in the design of the check valve. In this embodiment, valve member 8 is designed as a valve cone. As a result of this design, a definite reduction of switching hysteresis can be achieved as compared to the spherical design for valve member a.

Studies of the nozzle according to the invention compared with conventional injection nozzles with only one exit channel, indicate that the Reynolds numbers and laminar approach sections can be significantly reduced while the volume remains constant, by comparison to a bore with a larger diameter. The smaller Reynolds numbers in the injection nozzle according to the invention, with two or more exit channels, ensure that the flow remains laminar even at high temperatures and lower viscosity, and also at higher pressures and higher flow rates, and does not enter the range of turbulent flows. Because of the throttling effect of the relatively small diameter of the exit channels, a higher counterpressure also develops inside the support part providing a positive effect on the hysteresis between the opening and closing pressures of the check valve. This permits a reliable and defined opening and closing behavior of the check valves within a very narrow pressure range.

In addition to the embodiments discussed above, nozzle end piece 3 may have more than two exit channels depending on the required oil throughput, the available oil pressure, and the distance of the nozzle end piece from the piston bottom. A symmetrical arrangement of the nozzle channels is advantageous. For example, three exit channels can be arranged so that their axes form an equilateral triangle.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Injection nozzle for cooling the pistons of an internal combustion engine, comprising at least two at least approximately parallel exit channels having substantially the same diameter with center lines spaced from one another to a distance less than twice the diameter of the exit channels.

2. Injection nozzle according to claim 1, wherein the diameter of the exit channels is between 0.8 mm and 1.5 mm.

3. Injection nozzle according to claim 2, wherein the distance between the center lines of the exit channels is between 1.0 mm and 2.0 mm.

4. Injection nozzle according to claim 3, wherein the distance between the center lines of the exit channels is approximately 1.5 mm.

5. Injection nozzle according to claim 3, wherein the exit channels are expanded conically at their inlet ends.

6. Injection nozzle according to claim 5, comprising a nozzle end piece with the exit channels formed therein, said end piece being inserted into a sleeve-shaped support.

7. Injection nozzle according to claim 3, comprising a nozzle end piece with the exit channels formed therein, said end piece being inserted into a sleeve-shaped support.

8. Injection nozzle according to claim 1, wherein the diameter of the exit channels is approximately 1.2 mm.

9. Injection nozzle according to claim 8, wherein the distance between the center lines of the exit channels is between 1.0 mm and 2.0 mm.

10. Injection nozzle according to claim 6, wherein the distance between the center lines of the exit channels is approximately 1.5 mm.

11. Injection nozzle according to claim 1, wherein the distance between the center lines of the exit channels is between 1.0 mm and 2.0 mm.

12. Injection nozzle according to claim 11, wherein the distance between the center lines of the exit channels is approximately 1.5 mm.

13. Injection nozzle according to claim 1, wherein the exit channels are expanded conically at their inlet ends.

14. Injection nozzle according to claim 13, wherein the conical angle at the inlet ends of the exit channels is approximately 45°.

15. Injection nozzle according to claim 1, comprising a nozzle end piece with the exit channels formed therein, said end piece being inserted into a sleeve-shaped support.

16. Injection nozzle according to claim 15, wherein a check valve is provided in the support part.

17. Injection nozzle according to claim 16, wherein the check valve has a conical valve member.

* * * * *